US012687294B2

(12) United States Patent
Alhassan et al.

(10) Patent No.: US 12,687,294 B2
(45) Date of Patent: Jul. 21, 2026

(54) COOLED FLARE TIP BARREL

(71) Applicant: SAUDI ARABIAN OIL COMPANY, Dhahran (SA)

(72) Inventors: Qasem Jawad Alhassan, Alhofuf (SA); Min Hyun Cho, Dhahran (SA); Sayee Prasad Raghunathan, Dhahran (SA); Abdulaziz Hassan Al Tijani, Al Khobar (SA); Mohammad Hanif Khankhara, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 756 days.

(21) Appl. No.: 17/817,851

(22) Filed: Aug. 5, 2022

(65) Prior Publication Data

US 2024/0044489 A1 Feb. 8, 2024

(51) Int. Cl.
*F23G 7/08* (2006.01)

(52) U.S. Cl.
CPC .... *F23G 7/085* (2013.01); *F23D 2900/00018* (2013.01); *F23G 2209/14* (2013.01)

(58) Field of Classification Search
None
See application file for complete search history.

(56) References Cited

U.S. PATENT DOCUMENTS

| | | | | |
|---|---|---|---|---|
| 2,761,496 | A | 9/1956 | Verner et al. | |
| 4,573,906 | A | 3/1986 | Schwartz et al. | |
| 5,865,613 | A | 2/1999 | Rajewski | |
| 2007/0238058 | A1 * | 10/2007 | Zhu | F23G 7/085 431/202 |
| 2012/0231399 | A1 | 9/2012 | Beck et al. | |
| 2022/0034506 | A1 * | 2/2022 | Rajewski | F23G 7/085 |

FOREIGN PATENT DOCUMENTS

| | | | | |
|---|---|---|---|---|
| CN | 106402905 | A | | 2/2017 |
| CN | 212527039 | U | * | 2/2021 |
| JP | 5066103 | B2 | | 11/2012 |
| KR | 20120048315 | A | * | 5/2012 |
| KR | 20200007592 | A | * | 1/2020 |
| WO | 2020252332 | A1 | | 12/2020 |

OTHER PUBLICATIONS

International Search Report issued in corresponding International Application No. PCT/US2023/029469; mailed Jan. 24, 2024 (7 pages).

Written Opinion of the International Searching Authority issued in corresponding International Application No. PCT/US2023/029469; dated Jan. 24, 2024 (10 pages).

* cited by examiner

*Primary Examiner* — Jason Lau
(74) *Attorney, Agent, or Firm* — Osha Bergman Watanabe & Burton LLP

(57) ABSTRACT

A flare tip assembly includes a barrel having a barrel wall with an inner surface and an outer surface, an interior cavity defined within the inner surface and extending axially through the barrel, and internal channels formed through the barrel wall. The internal channels have a first opening at a lower axial end of the barrel wall and a second opening at an opposite, upper axial end of the barrel wall, and the internal channels are enclosed between the inner surface and the outer surface of the barrel wall. The flare tip assembly further includes a pilot positioned proximate to the upper axial end of the barrel.

6 Claims, 7 Drawing Sheets

COOLED FLARE TIP BARREL

BACKGROUND

Flare stacks are often utilized in oil and gas operations to dispose of unwanted gases which cannot be transported away from the operation site or cannot be utilized for another purpose. Further, flare stacks may be incorporated into a hydrocarbon facility's over-pressure protection system, relieving pressure where necessary. Flare systems can be used during scheduled start up or shut down operations, as well as depressurization procedures for process equipment maintenance. A flare stack may refer to a vertical tower and attached burners near to the tip, which may be used to ignite and burn combustible waste gases produced in oil and gas operations. FIG. 1 shows a conventionally used flare stack 1, fitted with a conventionally used flare tip 3. The flare tip 3 may be equipped with a windshield 5, a retention ring 7, and a refractory lining 9. The flare tip 3 may also be equipped with a pilot 11, which may be used to ignite and burn waste gases, which creates a flame 13 atop the flare tip 3. Flare tip technologies have evolved to improve safety and environmental performance with the focus primarily on achieving high combustion efficiency and smokeless operation.

Flare tips are subjected to high temperatures. These high temperatures may lead to metallurgical degradation in certain materials through microstructural changes (for e.g., stigmatization of austenitic stainless steels), and eventually reduction in flare tip life due to increased fatigue cracking susceptibility. Some flare tip designs typically utilize injection of air, steam or a combination along with the flare gas to improve combustion efficiency, thus producing smokeless flaring.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to a flare tip assembly. The flare tip assembly may include a barrel, which may comprise a barrel wall having an inner surface and an outer surface, an interior cavity defined within the inner surface and extending axially through the barrel, and internal channels formed through the barrel wall. The internal channels may have a first opening at a lower axial end of the barrel wall and a second opening at an opposite, upper axial end of the barrel wall, and the internal channels may be enclosed between the inner surface and the outer surface of the barrel wall. The flare tip assembly may further include a pilot positioned proximate to the upper axial end of the barrel.

In another aspect, embodiments disclosed herein relate to a method of cooling a flare tip. The method may include providing a flare tip on a flare stack, where the flare tip comprises an internal channel extending from a lower axial end proximate the flare stack to an upper axial end. The method may further include providing a supply line along the flare stack, where the supply line comprises a nozzle positioned proximate the lower axial end of the flare tip, suppling a cooling fluid through the supply line, and spraying the cooling fluid from the nozzle into the internal channel at the lower axial end of the flare tip. The method may also include using heat from a flame from the flare tip to evaporate the cooling fluid as the cooling fluid moves through the internal channel, where evaporation of the cooling fluid cools the flare tip.

In yet another aspect, embodiments disclosed herein relate to a flare tip. The flare tip may include a first barrel, a second barrel connected to and disposed around the first barrel, and an annular region formed between the first barrel and the second barrel. The annular region may be self-contained between the first barrel and the second barrel and extends from a first opening at a lower axial end of the first and second barrels to a second opening at an opposite, upper axial end of the first and second barrels. The annular region may have a thickness that is approximately 30-40% of the total thickness of the flare tip wall (formed by the assembled first and second barrels), where the first barrel and the second barrel each may include a solid wall.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency. The size and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn are not necessarily intended to convey any information regarding the actual shape of the particular elements and have been solely selected for ease of recognition in the drawing.

DETAILED DESCRIPTION

Figure 1:
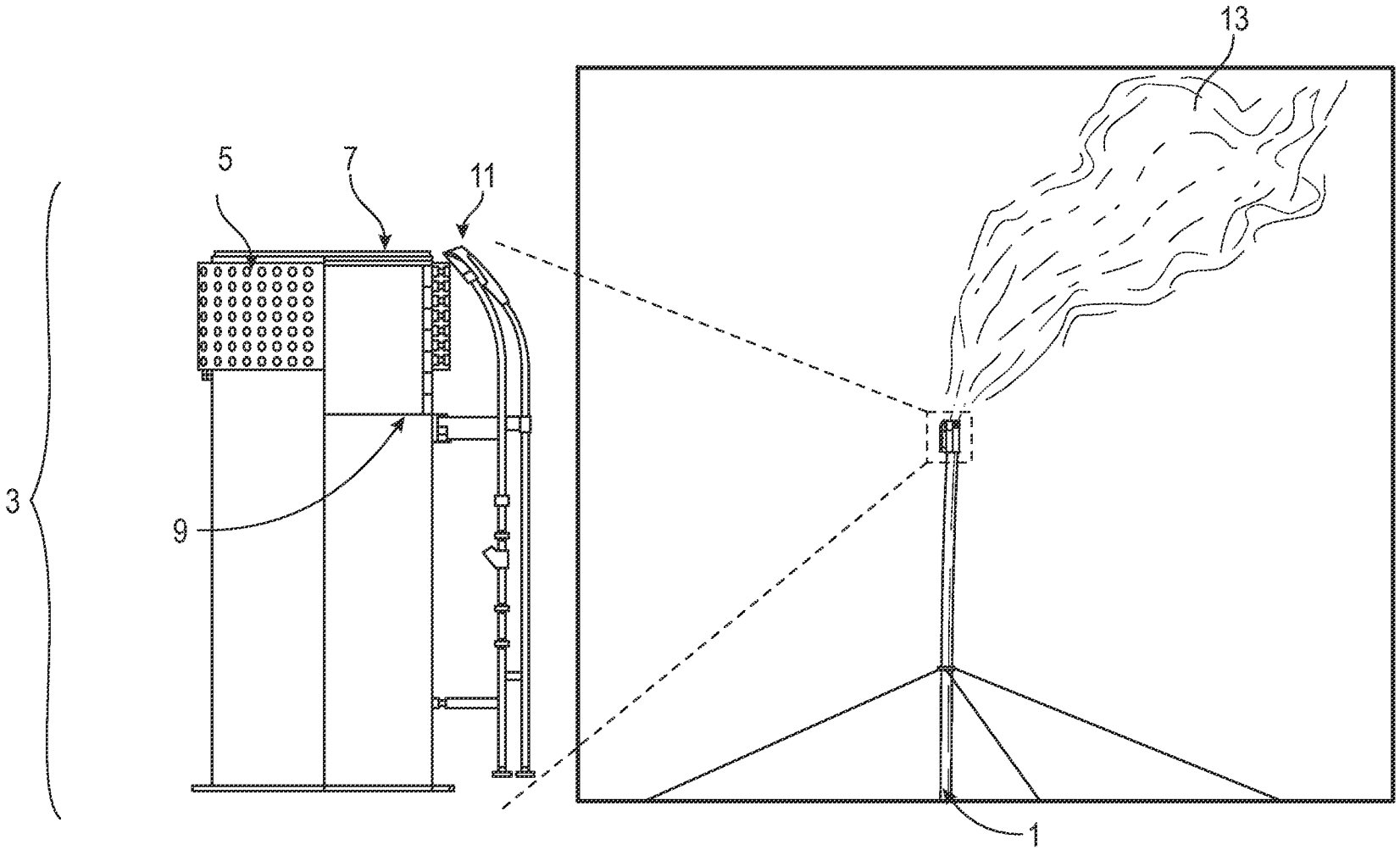
FIG. 1 (Prior Art)
FIG. 1 shows a conventionally used flare tip and flare stack.

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before," "after," "single," "outer," "inner," and other such terminology. Rather, the use of ordinal numbers is to distinguish between the elements. By way of an example, a first element is distinct from a second element, and the first element may encompass more than one element and succeed (or precede) the second element in an ordering of elements.

Flare tips are critical flare system components, which conventionally maintain stable flames as specified under defined service conditions and over an entire operating range, e.g., for a minimum of 5 years when installed and operated in accordance with the manufacturer's recommendations. Flare tips are designed to minimize flame impingement on the outside or the inside of the tip, and on any part of the support structure regardless of gas flow rate, wind speed or wind direction. In many oil and gas facilities, large single flare tips experience frequent damage due to flame impingement (when the flame contacts the tip) at the daily normal continuous flaring rates. In such situations, the flare tip may become damaged due to continuous flame impingement and localized overheating. Internal explosion can also occur, which may further shorten the life of the flare tip. Thermal gradient and metal temperature calculations using Fourier's laws show that current tip designs may have a peak metal skin temperature of 650-700° C. and a gradient of 300-400° C. along the length of the flare tip barrel. Exposure of a tip barrel to this temperature gradient results in non-uniform stresses along the length of the barrel leading to deformation of the tip, and typical Mean Time Between Failures (MTBF) of 4-6 years (after which tips are typically replaced due to integrity and/or functionality reasons).

Flare tips and associated components are conventionally constructed of suitable heat resistant, high temperature oxidation resistant materials, which may include austenitic stainless-steel materials such as 309, 310, 310H, 310S, 321 or nickel alloys. Typically, the 3xx stainless steel materials used have a fully austenitic microstructure. However, sustained exposure to high temperatures from the flame can lead to sigma phase formation, which refers to a metallurgical constituent having low ductility and toughness and affects strength and fatigue life. Additionally, the temperature gradients along the length and thickness of the flare tip invariably lead to deformation of the flare tip.

Metallurgical degradation and distortion of a flare tip are primarily related to the heat transfer in a flare tip system. Heat generated by a flame is transferred to a flare tip, which increases flare tip temperature and the thermal gradient along the flare tip. The accumulation of the absorbed heat in the flare tip continuously increases the temperature of the flare tip, with saturation reached when the heat transfer into the flare tip is equal to the heat dissipation. In reality, the flame may fluctuate due to wind speed, wind direction, and gas flow rate. This may cause heat transfer variations leading to thermal stress on the flare tip, which induces thermal fatigue. In some situations, flashback of the flame into the barrel, colloquially referred to as 'lazy-flame', may occur, which can cause excessive heating of the flare tip. This may occur when the flow rate of waste gas drops below a minimum value, causing internal burning, where the flame burns inside the flare tip.

Flare tips and associated welds can experience fatigue cracking due to thermal cycling, Environmental Assisted Cracking (EAC), and high/ambient temperature corrosion (due to reducing or oxidizing atmospheres). EAC is particularly applicable to flare tips composed of austenitic stainless-steel materials. When damages limit the functionality or repairability of the flare tip, the flare tip must be replaced. Flare tip service life can vary depending on field implementation conditions.

In one aspect, embodiments disclosed herein relate to flare tip barrel designs which may be installed on top of a flare stack. The flare tip designs may generally include a flare tip barrel design having internal channels extending axially through the flare tip wall, where a fluid (e.g., air) may be directed through the internal channels to cool and reduce stresses along the flare tip wall. For example, flare tip barrel design according to embodiments of the present disclosure may include a double walled barrel (also referred to herein as "double-barreled flare tips"), where internal channels are formed by the annular region between the double barrels, or a single walled barrel with internal channels formed through the barrel wall (also referred to herein as "single-barreled flare tips"). Embodiments of the flare tip designs disclosed herein may reduce peak temperatures and may produce uniform temperature gradients and stresses throughout the barrel of the flare tip, which may increase the life of the flare tip. In another aspect, embodiments disclosed herein relate to a method of cooling a flare tip.

In the following description of FIGS. 2-4 and 6A-6B, any component described regarding a figure, in various embodiments disclosed herein, may be equivalent to one or more like-named components described with regard to any other figure. For brevity, descriptions of like-named components may not be repeated with regard to each figure. Thus, each and every embodiment of the components of each figure is incorporated by reference and may be optionally present within every other figure having one or more like-named components. Additionally, in accordance with various embodiments disclosed herein, any description of the components of a figure is to be interpreted as an optional embodiment which may be implemented in addition to, in conjunction with, or in place of the embodiments described with regard to a corresponding like-named component in any other figure.

Figure 2:
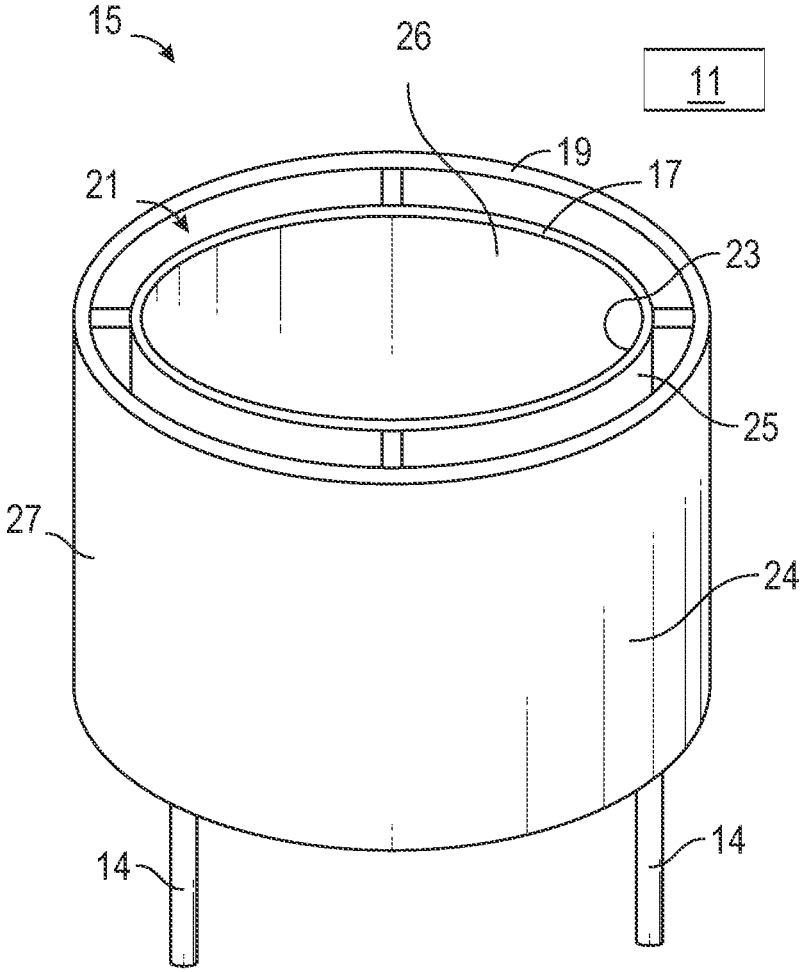
FIG. 2 shows a double-barreled flare tip in accordance with one or more embodiments.
Figure 6A:
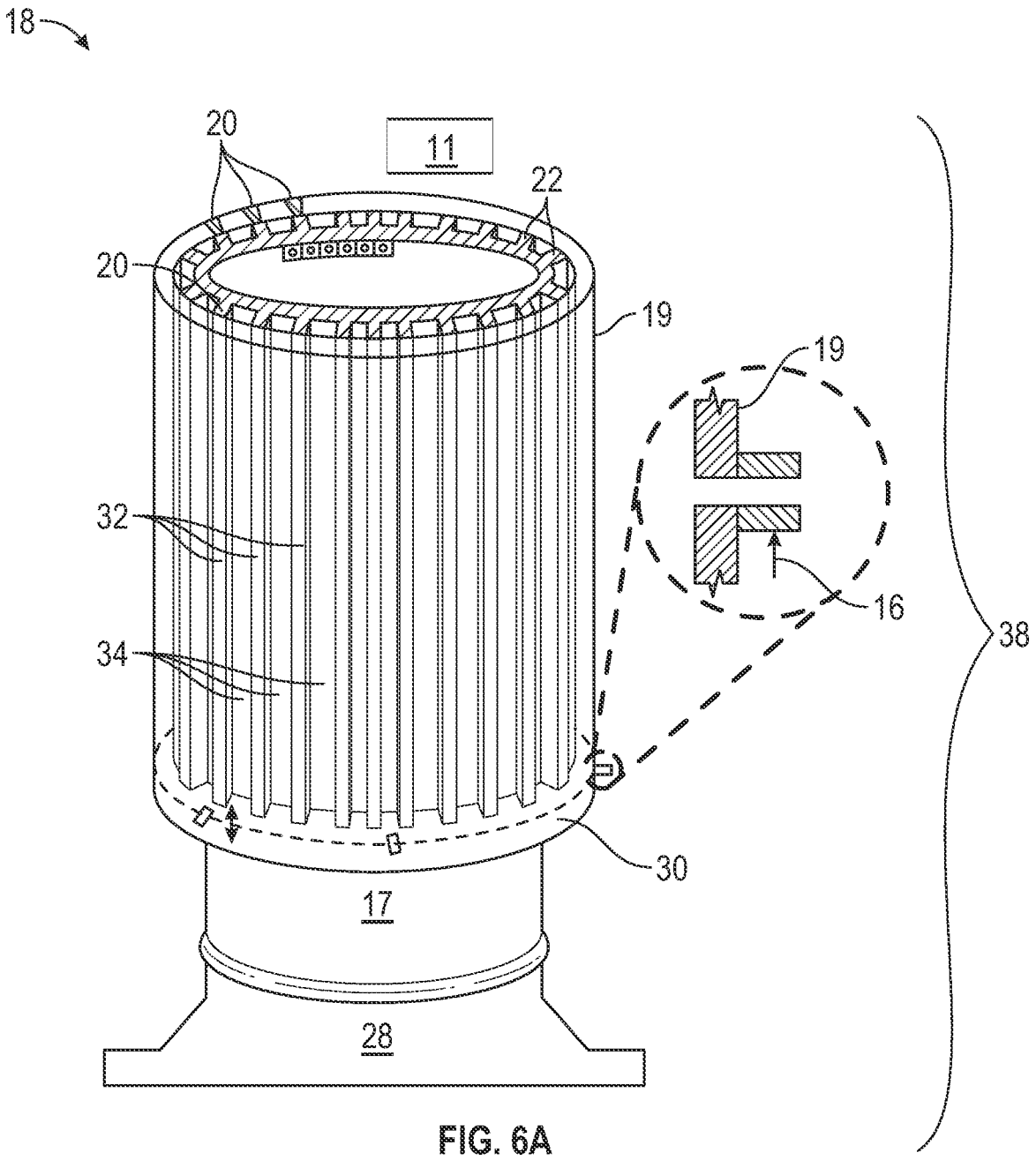
FIGS. 6A-6B show a double-barreled flare tip in accordance with one or more embodiments of the present disclosure.
Figure 6B:
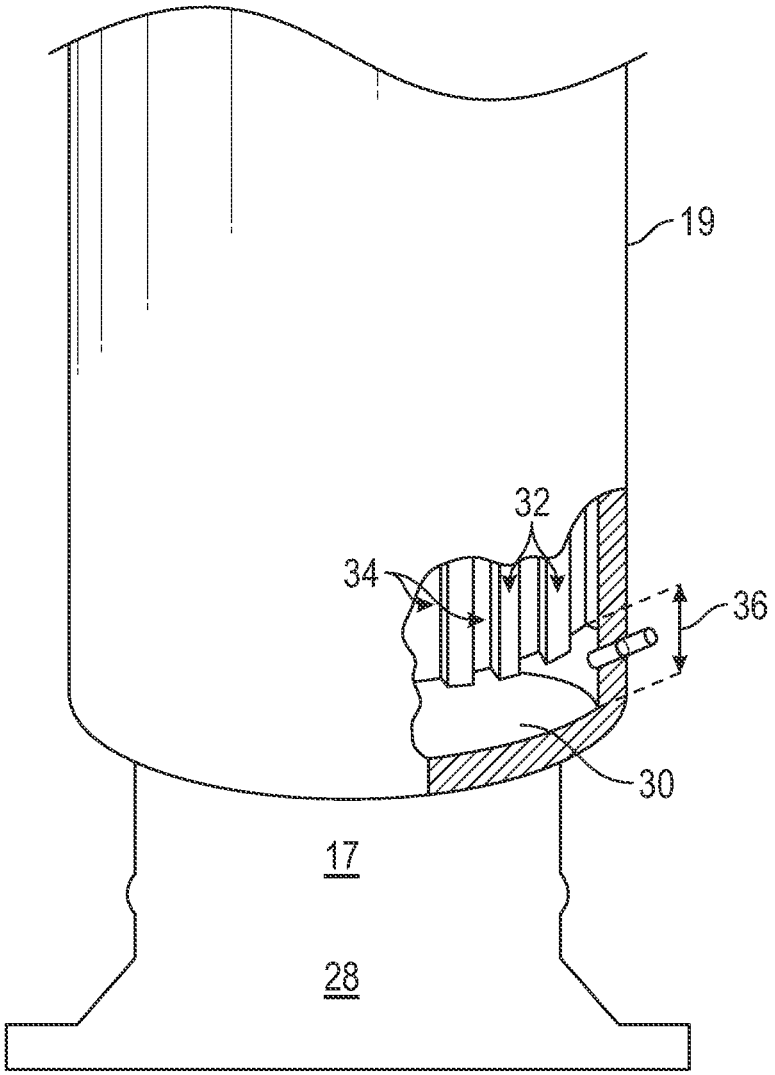

Turning now to FIGS. 2 and 6A-6B, FIGS. 2 and 6A-6B show two examples of a double-barreled flare tip 15, 18 in accordance with one or more embodiments. Features of either embodiment may be combined to produce a number of other embodiments. The separation of features into FIGS. 2 and 6A-6B is for illustrative purposes only and is not intended to limit the scope of this disclosure.

Referring first to FIG. 2, the double-barreled flare tip 15 may have a first barrel 17 disposed within a second barrel 19, where an annular region 21 may be created between the first and second barrels 17, 19. In one or more embodiments, the annular region 21 may be self-contained and isolated from both the interior cavity of the first barrel 17 and the exterior of the second barrel 19 of the flare tip 15. Further, in the same embodiments, the first and second barrels 17, 19 may be solid, with no perforations extending through the wall of either barrel. Thus, unlike a perforated windshield, an outer second barrel 19 around a first barrel may prevent air flow radially through the wall of the second barrel 19. In one or more embodiments, the thickness of the annular region may be approximately 30-40% (e.g., approximately a third) of the total thickness of the flare tip 15 wall. As used herein, "approximately" or like terms means that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide. The first and second barrels 17, 19 may be concentrically held together, for example, using connection elements (e.g., flutes, welds, support brackets, etc.) positioned in the annular region 21 or by a retention ring positioned at an axial end of the double-barreled assembly. In one or more embodiments, the first and second barrels 17, 19 may be connected using joining techniques such as brazing or welding, which may be applied inside the annular region 21 or outside the second barrel 19. In one or more embodiments, the first and second barrels 17, 19 may be composed of a material selected from either the 310 class of stainless steel or the 800 class of nickel.

A cooling fluid may be directed through internal channels formed by the annular region 21 by injecting the cooling fluid from a provided fluid supply. For example, as described in more detail below, one or more outlets 14 of the fluid supply may be oriented to inject the fluid into a first axial end of the annular region 21, such that the fluid flows through the annular region 21 and out an opposite, second axial end of the annular region 21. In one or more embodiments, a pilot 11 may be positioned proximate the second axial end of the flare tip 15, such that gas exiting the interior cavity of the first barrel 17 may be ignited when the pilot is lit. In order to allow fluid flow through the internal channels formed by the annular region 21 to cool the flare tip 15, the internal channels may be encircled by the first and second barrels 17, 19, such that fluid flowing therethrough is confined in the radial direction between the first and second barrels 17, 19 and free to flow in the axial direction between openings at opposite axial ends of the barrels 17, 19. For example, by arranging solid, non-perforated barrels 17, 19 in a concentric manner, such as shown in FIG. 2, fluid flowing axially through the annular region 21 between the first and second barrels 17, 19 may be contained through the axial length of the barrels 17, 19, thereby improving cooling effects to the flare tip 15, as described herein.

Turning now to FIGS. 6A-6B, the double-barreled flare tip 18 may also have a first barrel 17 disposed within a second barrel 19, with an annular region 21 formed there between. A pilot 11 may be positioned proximate the second axial end of the flare tip 15 to ignite flaring gas exiting the interior cavity of the first barrel 17. In one or more embodiments, the first barrel 17 may have a plurality of flutes 32 arranged equally around its circumference. A flute 32 may refer to a raised region which extends axially along the first barrel 17, and each flute 32 may be separated from two neighboring flutes 32 by a recess 34. As such, the plurality of flutes 32 may be alternated with a plurality of recesses 34 around the circumference of the first barrel 17. The alternating flutes 32 and recesses 34 may extend axially (parallel with the longitudinal axis of the flare tip) or generally axially (e.g., helically or sloped) along the flare tip 18.

In some embodiments, the second barrel 19 may be held concentrically around the first barrel 17 via attachment to the flutes 32 using joining techniques such as brazing or welding, which may be applied inside the annular region 21 or outside the second barrel 19. In one or more embodiments, welds 20 may be applied to the exterior of the second barrel 19, which may penetrate through the second barrel 19 such that the second barrel 19 fuses to the flutes 32 disposed on the first barrel 17. In other embodiments, brazing filer 22 may be applied between the flutes 32 and the second barrel 19. In some embodiments, the second barrel 19 may be tightly fitted around the flutes 32 without welding or brazing.

Embodiments such as that depicted in FIGS. 6A-6B may also be formulated using 3D printing methods, where the first barrel 17, flutes 32, second barrel 19, and/or any other needed connections are formulated in one print job as an integrally formed component.

The recesses 34 form internal channels through the flare tip 18, through which cooling fluid may be flowed. In some embodiments, the cooling fluid may be injected into the internal channels formed by the recesses 34 from a lower axial end of the internal channels, such as shown in FIG. 2. As used herein, "lower" or "bottom" refers to the relative direction or position when the flare tip is installed on a flare stack. For example, when a flare tip is installed on a flare stack mounted to a ground processing site, the lower axial end of the flare tip is the axial end of the flare tip closest to the ground.

In some embodiments, cooling fluid may be injected into an annular channel extending annularly around a lower axial end of the flare tip, where the annular channel is in fluid communication with each of the plurality of recesses 34. For example, as shown in FIGS. 6A-6B, an annular channel 36 may be formed at a lower axial end of the recesses 34. The annular channel 36 may be formed by the annular region between the first and second barrels 17, 19 and extend axially between a bottom plate 30 and the end faces of the flutes 32 (at the lower axial end of the recesses 34). In one or more embodiments, the annular channel 36 may have a height of 5-10 mm, for example. The bottom plate 30 may be connected between the first and second barrels 17, 19, and thus, may act as a connection mechanism between the first and second barrels 17, 19.

An inlet 16 may be located along the lower axial end of the second barrel 19, such that the inlet fluidly communicates with and is at a shared axial position with the annular channel 36 formed between the end face of each flute 32 and the bottom plate 30, as shown in FIG. 6B. In one or more embodiments, there may be a plurality of inlets 16 distributed equally around the circumference of the second barrel 19 and in fluid communication with the annular channel 36. For example, in some embodiments, there may be between 4 and 8 inlets 16 arranged circumferentially around the second barrel 19. The inlets 16 may be located as close to the bottom of the second barrel 19 as possible, along the bottom plate or in another position along the lower axial end of the second barrel 19, such that a cooling fluid may be injected through the inlet(s) 16 in a manner that directs the cooling fluid in a direction from the lower axial end of the internal channels (e.g., recesses 34) to exit the upper axial end of the internal channel. As fluid flows from the annular channel 36 and through the internal channels, the fluid may be contained in the internal channels between the first and second barrels 17, 19 until the fluid exits the upper axial end of the tip 18. In such manner, cooling fluid may be directed through the flare tip 18 between the first and second barrels 17, 19 along the entire axial length, or most of the axial length, of the flare tip 18, e.g., at least 90 percent of the entire axial length of the flare tip 18.

In one or more embodiments, a double-barreled flare tip 15, 18 may be connected to the flare stack by means of a flange connection 28, such as shown in FIGS. 6A-6B. The double-barreled flare tip 15, 18 may be attached to the flange connection 28 to form a flare tip assembly 38, where the first barrel 17 directly connects to the flange connection 28. The flare tip assembly 38 may be attached to the stack using a mechanical fastener. In one or more embodiments, mechanical fastener may include any type of mechanical fastening without limiting the scope of this disclosure.

In one or more embodiments, a cooling fluid (e.g., air or steam) may be flowed through one or more internal channels formed by the annular region 21 between the first and second barrels 17, 19 and the barrel connection elements. For example, a fluid supply line may be positioned along a flare stack to supply cooling fluid to the flare tip 15, where an outlet 14 of the fluid supply line may be held at a lower axial end of the annular region 21. The outlet 14 may be fitted with a nozzle (e.g., a lance), which may be oriented to spray a fluid from the fluid supply line into an internal channel formed by the annular region 21. In one or more embodiments, an external manifold may be used to ensure uniform distribution of fluid into the internal channel. In some embodiments, the nozzle may be adjustable. As cooling fluid is sprayed from the nozzle through the annular region 21 from the lower axial end, the sprayed fluid particles may be evaporated by the heat in the flare tip 15. In one or more embodiments, a nozzle may be connected to each inlet 16 disposed circumferentially around the second barrel 19.

A cooling fluid such as air or steam may be injected into one or more internal channels formed through the annular region to introduce forced thermal convection into the double-barreled flare tip. Thermal convection around a flare tip is dependent on heat transfer coefficient, surface area of the flare tip and temperature difference between the flare tip surface and its surroundings. In one or more embodiments, the double-barreled flare tip may have a surface area more than twice the surface area of conventionally used flare tips.

There are mainly two types of heat convection: natural convection and forced convection. Typically, forced convection has a heat transfer coefficient ten times higher than that of natural convection, which also depends on the object shape, velocity of fluid and type of fluid. As such, forced convection is preferred for design of flare tip cooling systems. If the heat dissipation by thermal convection is increased, more heat may be transferred away from the flare tip, and thus the surface temperature of flare tip may be reduced.

Referring again to FIG. 2, in a double-barreled flare tip, the first barrel 17 may be formed by a generally tubular shaped wall having a first inner surface 23 facing the inner flow path of the tip and a first outer surface 25 facing the second barrel 19. Similarly, the second barrel 19 may be formed by a generally tubular shaped wall having a second inner surface facing the first barrel 17 and a second outer surface 27 facing the exterior of the tip 15. In one or more embodiments, an outer metallic sheath 24 may be applied to the outer surface 27 of the second barrel 19. The outer metallic sheath 24 may be composed of a high thermal conductivity material, which may improve heat dissipation from the double-barreled flare tip 15. For example, in some embodiments, the high thermal conductivity material may be copper. The combination of the outer metal sheath 24 on the outer surface 27 of the second barrel 19 forms a bi-metallic second barrel 19. In one or more embodiments, the thickness of the outer metallic sheath 24 may be more than or equal to half the thickness of the wall of the first or second barrel 17, 19, which may allow a sufficient amount of heat to conduct through the outer metallic sheath 24.

The high thermal conductivity material of the outer metallic sheath 24 may also increase heat conduction in the double-barreled flare tip 15, 18. Heat transferred by thermal conduction is a function of thermal conductivity and temperature gradient, which are inversely correlated. For example, if a coating with high thermal conductivity is used, the thermal gradient along a flare tip can be decreased and thermal conduction can be increased. High thermal conduction can increase heat dissipation away from the flare tip, thereby lowering the temperature of the flare tip. To achieve a sufficient heat dissipation rate, the thermal conductivity of the outer metallic sheath 24 may be more than twenty times the thermal conductivity of the material used to form the walls of the double-barreled flare tip 15, 18. For example, the thermal conductivity of the material used to form the walls of the double-barreled flare tip 15, 18 may be in the range of 15 to 20 W/mK, whereas the thermal conductivity of the outer metallic sheath 24 may be in the range of 300 to 400 W/mK. In one or more embodiments, the melting point of the outer metallic sheath 24 may not be less than 1000° C.

Both the wall material of the double-barreled flare tip 15 and the high thermal conductivity material of the outer metallic sheath 24 have a coefficient of thermal expansion (CTE). In order to minimize the distortion between the high thermal conductivity material and the wall material of the double-barreled flare tip, the difference between the respective CTE values is minimized. In one or more embodiments, the maximum deviation of CTE values of the wall material and the coating material is ±5%.

In some embodiments, the second barrel 19 may have a plurality of heat dissipation fins (not shown) positioned circumferentially around the second outer surface 27. For example, heat dissipation fins may be raised portions formed integrally with the second barrel 19 (or an outer surface of a single-barreled embodiment) and extending radially outward a distance from the second outer surface 27.

In one or more embodiments, an inner coating 26 may be applied to the first inner surface 23. The inner coating 26 may be composed of a low emissivity material to minimize heat absorption from the flame. The low emissivity material may have a low coefficient of radiation, e.g., less than 0.8, which may reduce the absorbed energy from the flame. For example, in one or more embodiments, the low emissivity material may be a low emissivity Thermal Barrier Coating (TBC) which, with or without metallic interlayers, may be applied using thermal spray processes. Thermal radiation, though less significant in impact than thermal convection and thermal conduction, may still cause distortion of flare tips due to the significant temperature difference between the flare tip and the flame, which may reach temperatures of around 1200° C., for example. As such, application of a material with a low coefficient of radiation, such as the inner coating 26, may assist in minimizing thermal radiation effects on the double-barreled flare tip 15.

Figure 3A:
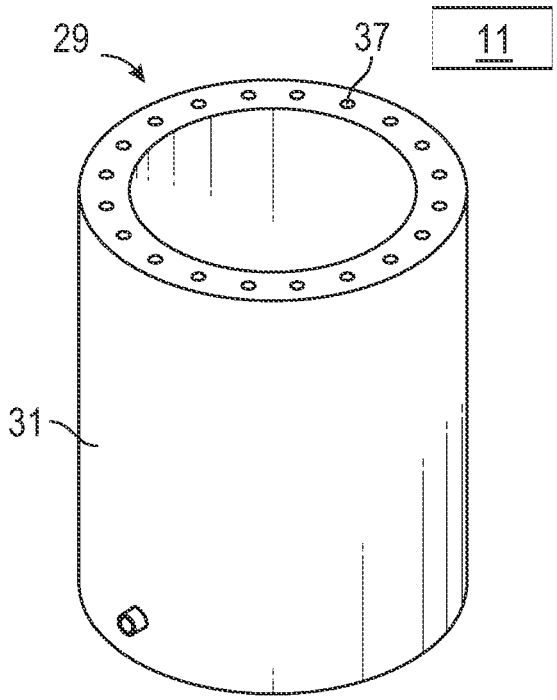
FIGS. 3A and 3B show a single-barreled flare tip in accordance with one or more embodiments.
Figure 3B:
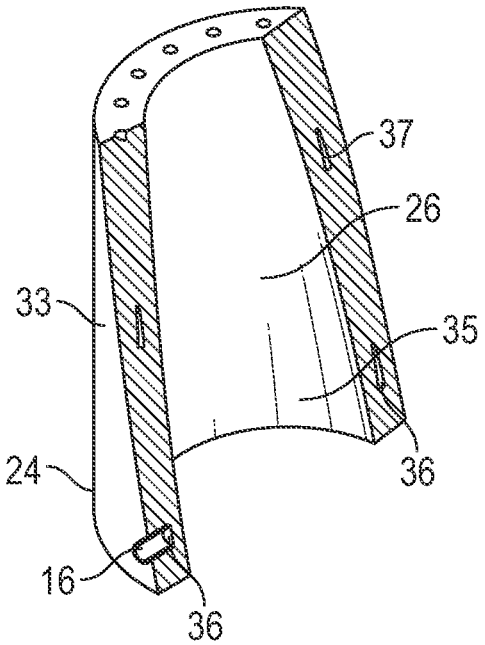

Turning now to FIGS. 3A and 3B, FIGS. 3A and 3B show an example of a single-barreled flare tip 29 in accordance with one or more embodiments. FIG. 3A shows a perspective view of the flare tip 29, and FIG. 3B shows a cross-section of the flare tip 19 taken along a diagonal to the longitudinal axis. The single-barreled flare tip 29 may have a barrel 31, which has an outer surface 33 and an inner surface 35. Similar to the double-barreled flare tip 15 embodiments, the outer metallic sheath 24 may be applied to the outer surface 33, and the inner coating 26 may be applied to the inner surface 35. In one or more embodiments, the outer metallic sheath 24 may be in tight contact with the outer surface 33. In one or more embodiments, a pilot 11 may be positioned proximate an upper axial end of the flare tip 15 to ignite flaring gas.

As best seen in the cross-sectional view of FIG. 3B, the single-barreled flare tip 29 may include a plurality of internal channels 37 machined axially through the wall of the barrel 31. However, there are also embodiments in which the internal channels 37 may be formed by molding, casting, or 3D printing the single-barreled flare tip having the internal channels 37 formed therein. In such manner, the wall of the barrel 31 forms the walls of the internal channels. Additionally, by forming internal channels 37 axially through the wall material of a flare tip 29, fluid flowing through the internal channels 37 may be contained within the flare tip wall through most or the entire axial length of the flare tip 29 (e.g., at least 90 percent of the entire axial length of the flare tip), thereby improving the cooling effects to the flare tip. In one or more embodiments, each internal channel 37 may have a diameter ranging from about 30% to 40% (e.g., approximately a third) of the thickness of the flare tip 29 wall.

The internal channels 37 may extend an axial length of the barrel 31, from a lower axial end to an opposite upper axial end of the barrel 31. In some embodiments, as shown in FIGS. 3B, an annular channel 36 may be circumferentially and internally formed around the lower axial end of the barrel 31 wall, where the internal channels 37 may extend less than the entire axial length of the barrel 31, from the annular channel 36 to the upper axial end of the barrel 31. In such embodiments, an inlet 16 may be in fluid communication with the annular channel 36, where cooling fluid may be injected into the annular channel 36 to flow through the fluidly connected internal channels 37 and exit the upper axial end of the barrel 31.

In some embodiments, internal channels 37 may extend the entire axial length of the barrel 31, from a bottom side of the lower axial end to the top side of the upper axial end of the barrel. In such embodiments, cooling fluid may be separately injected into each of the internal channels 37 at the lower axial end of the barrel.

Similar to the internal channel(s) formed by an annular region 21 of the double-barreled flare tip 15 discussed above, internal channels 37 formed through the wall of a single-barreled flare tip 29 may allow for injection of air or steam to encourage forced convection in the flare tip 29 and enhance heat dissipation away from the flare tip 29. The internal channels 37 may increase the surface area for thermal convection, enhance heat dissipation rates within the barrel 31 of the single barreled flare tip 29, which may reduce peak temperatures, and ensure uniform temperature gradients and thermal stresses throughout the barrel 31.

A single-barreled flare tip 29 may be connected to a flare stack using conventional connection components, such as a flange. In some embodiments, a cooling fluid may be supplied through the flange to enter internal channels through the barrel wall. In some embodiments, a cooling fluid may be supplied through one or more supply lines mounted along the exterior of the flare stack on which the flare tip as assembled.

Figure 4:
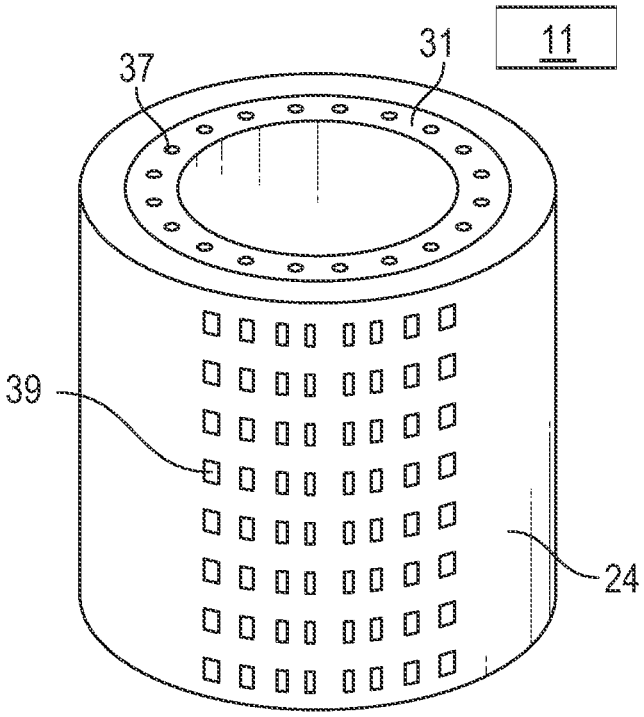
FIG. 4 shows a double-barreled flare tip in accordance with one or more embodiments.

FIG. 4 shows another example of a single-barreled flare tip 29 in accordance with one or more embodiments. In such embodiments, similar to those discussed above, a pilot 11 may be positioned proximate the second axial end of the flare tip 15 to ignite flaring gas. In one or more embodiments, a plurality of heat dissipation fins 39 may be disposed along the outer surface 33 of the barrel 31. In one or more embodiments, the plurality of heat dissipation fins 39 may be welded to the outer surface 33 of the barrel 31 (or the second outer surface 27 of the second barrel 19 in a double-barreled embodiment). In one or more embodiments, the heat dissipation fins 39 may be composed of the same or similar materials as the outer metallic sheath 24. In some embodiments, an outer metallic sheath 24 may be applied over the heat dissipation fins 39, where the outer metallic sheath 24 may conform in shape with the fins 39 to provide an outermost surface of the flare tip 29 with the metallic sheath material in the raised pattern of the fins 39. In some embodiments, heat dissipation fins 39 may be integrally formed with the wall of the barrel 31 as raised portions extending outwardly from the barrel 31.

The heat dissipation fins 39 may increase the surface area for thermal convection. Various patterns, shapes, and sizes of heat dissipation fins 39 may be provided around different portions of or entirely around the outer surface of the barrel 31. In one or more embodiments, the heat dissipation fins 39 may be arranged in a vertical direction along the outer surface 33 of the barrel 31.

Figure 5:
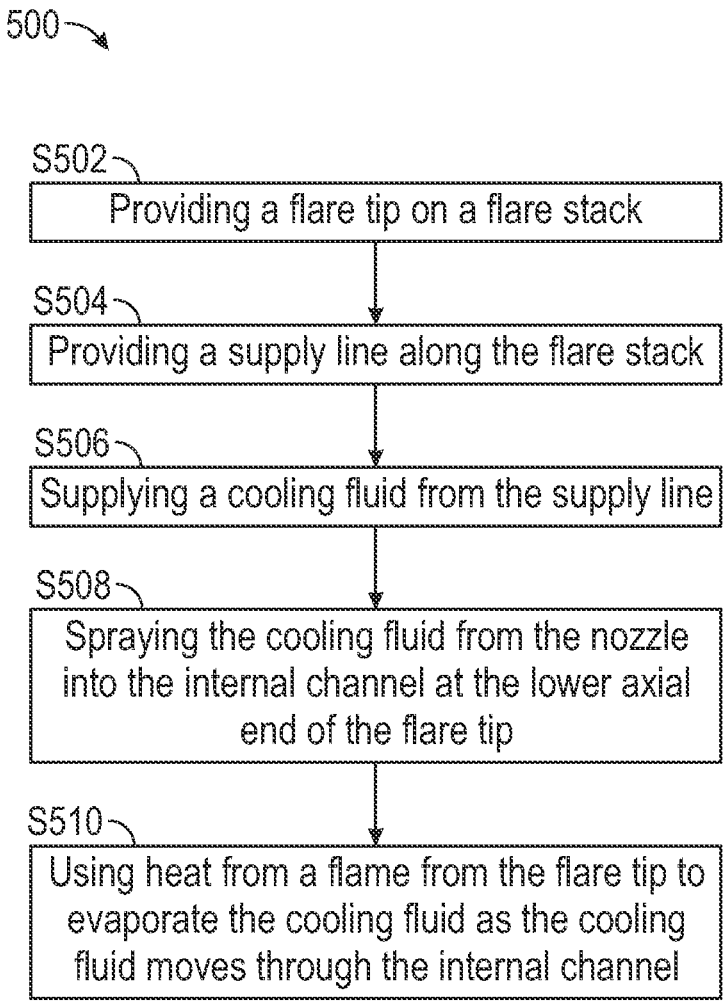
FIG. 5 shows a flowchart of a method in accordance with one or more embodiments.

Turning now to FIG. 5, FIG. 5 depicts a flowchart in accordance with one or more embodiments. More specifically, FIG. 5 depicts a flowchart 500 of a method for cooling a flare tip. Further, one or more blocks in FIG. 5 may be performed by one or more components as described in FIGS. 2-4 and 6A-6B. While the various blocks in FIG. 5 are presented and described sequentially, one of ordinary skill in the art will appreciate that some or all of the blocks may be executed in different orders, may be combined, may be omitted, and some or all of the blocks may be executed in parallel. Furthermore, the blocks may be performed actively or passively. The steps discussed in FIG. 5 may refer to single-barreled flare tip embodiments and double-barreled flare tip embodiments.

Initially, in step S502, a flare tip may be provided on a flare stack. In one or more embodiments, the flare tip may be a double-barreled flare tip 15. In other embodiments, the flare tip may be a single-barreled flare tip 29. In both types of embodiments, an internal channel may be provided through the flare tip, where the internal channel extends from a lower axial end proximate the flare stack to an opposite upper axial end of the flare tip. In embodiments with a double-barreled flare tip 15, the internal channel may be the annular region 21 formed between concentrically positioned first and second barrels 17, 19. In embodiments with a single-barreled flare tip 29, an internal channel 37 may be formed through a barrel wall and extend axially through the axial length of the barrel 31 of the flare tip 29. In some embodiments, a flange connection 28 of the flare tip may be threadably connected to the flare stack.

A supply line may be provided along the flare stack to the lower axial end of the flare tip, S504. In one or more embodiments, the supply line may include a nozzle positioned proximate the lower axial end of the flare tip. In one or more embodiments, the nozzle may be a fluid injection lance. The supply line may supply a cooling fluid to the flare tip, S506.

In some embodiments, initially, the cooling fluid may enter the supply line in gaseous form. This gaseous cooling fluid may be compressed within the supply line to form a liquid cooling fluid. In one or more embodiments, the cooling fluid may be air or steam. However, there are other embodiments in which the cooling fluid may be any fluid which has a boiling point less than 100° C. and which may transition from a gaseous form to a liquid form through compression within the supply line.

The cooling fluid may be sprayed from the nozzle into the lower axial end of the internal channel of the flare tip, S508. The velocity of the fluid sprayed from the nozzle may be greater than 10 m/s in order to produce sufficient forced convection through the flare tip. Using heat from the flame extending from the flare tip, the cooling fluid may evaporate as the fluid moves through the internal channel, from the lower axial end toward the upper axial end of the flare tip, S510. During the phase change of the cooling fluid, the heat dissipation rate increases due to the latent heat of fusion of liquid particles. Thus, the injection/spraying of the cooling fluid into the internal channel of a flare tip can additionally improve the thermal convection rate to reduce peak temperatures and mitigate the distortion of the flare tip. Reduction of flare tip peak temperatures may assist in the mitigation of flare tip metallurgical degradation.

Embodiments of the present disclosure may provide at least one of the following advantages. In conventional flare systems, flare tips often distort and degrade due to the extremely high temperatures of flames and flaring gases, coupled with uneven temperature gradients and stresses within the barrels of the flare tips. Embodiments of the present disclosure allow for increased thermal convection and thermal conduction, as well as increased heat dissipation rates. This effectively lowers the peak temperature of the flare tip and ensures uniform temperature gradients and thermal stresses throughout the barrel of the flare tip. Optimization of thermal convection, conduction, and radiation in the flare tip system will also mitigate flare tip distortion due to metallurgic degradation of the materials from which the flare tip is composed, such as austenitic stainless steels. As a result, flare tip integrity may be ensured, and flare tip service life may be extended.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims.

What is claimed:

1. A method of cooling a flare tip, comprising:

providing a flare tip on a flare stack, wherein the flare tip comprises a wall and an internal channel extending along the wall from a lower axial end proximate the flare stack to an upper axial end;

providing a supply line along the flare stack, wherein the supply line comprises an outlet positioned proximate the lower axial end of the flare tip;

supplying a cooling fluid through the supply line;

spraying the cooling fluid from the outlet into the internal channel at the lower axial end of the flare tip; and using heat from a flame from the flare tip to evaporate the cooling fluid as the cooling fluid moves through the internal channel, wherein evaporation of the cooling fluid cools the wall of the flare tip and comprises:

increasing a heat dissipation rate;

increasing a heat conduction rate in the flare tip through an application of a high thermal conductivity material on an outer surface of the flare tip, the high thermal conductivity material comprises a copper material;

minimizing heat absorption by applying a low emissivity material on an inner surface of the flare tip; and increasing a thermal convection rate.

2. The method of claim 1, wherein the flare tip comprises:

a first barrel; and a second barrel held around the first barrel, wherein the internal channel is formed by an annular region between the first barrel and the second barrel.

3. The method of claim 1, wherein the flare tip comprises:

a barrel formed of the wall, the wall having the inner surface and the outer surface, wherein the internal channel is formed axially through the wall; and heat dissipation fins disposed around the outer surface of the barrel.

4. The method of claim 1, further comprising using heat dissipation fins disposed on the outer surface of the flare tip to increase an area of thermal convection.

5. The method of claim 1, wherein spraying the cooling fluid from the outlet into the internal channel further comprises spraying the cooling fluid at a velocity higher than 10 m/s to induce forced convection.

6. The method of claim 1, wherein supplying a cooling fluid comprises:

providing a gaseous cooling fluid in the supply line; and compressing the gaseous cooling fluid into a liquid cooling fluid prior to spraying the cooling fluid from the outlet.

* * * * *